United States Patent [19]

Fischer et al.

[11] 4,273,949

[45] Jun. 16, 1981

[54] ARC FURNACE ROOF

[75] Inventors: Otto Fischer; Wilfried Pulvermacher; Bernd Koch, all of Bochum, Fed. Rep. of Germany

[73] Assignee: Fried. Krupp Hüttenwerke Aktiengesellschaft, Bochum, Fed. Rep. of Germany

[21] Appl. No.: 60,182

[22] Filed: Jul. 24, 1979

Related U.S. Application Data

[63] Continuation-in-part of Ser. No. 30,862, Apr. 17, 1979, abandoned.

[51] Int. Cl.[3] ..... F27D 1/02; F27D 1/12

[52] U.S. Cl. ..... 13/35; 13/32

[58] Field of Search ..... 13/32, 35

[56] References Cited

U.S. PATENT DOCUMENTS 4,107,449 8/1978 Sosonkin et al. ..... 13/35

*Primary Examiner*—Roy N. Envall, Jr.

*Attorney, Agent, or Firm*—Kenyon & Kenyon

[57] ABSTRACT

An arc furnace roof has a central portion formed by a circular group of individually suspended segments having sides which cooperatively form openings for the passage of arcing electrodes. Each segment is formed by a metal shell having cooling water inlets and outlets and internal baffles causing cooling water to be guided through the shell so that cooling is adequate to avoid the need for lining the bottoms of the segments with thick refractory linings, the bottoms being only coated with a thin layer of refractory electrical insulation. The electrode openings have refractory electrical insulation to isolate the segments from electrode currents.

6 Claims, 2 Drawing Figures

Fig.2
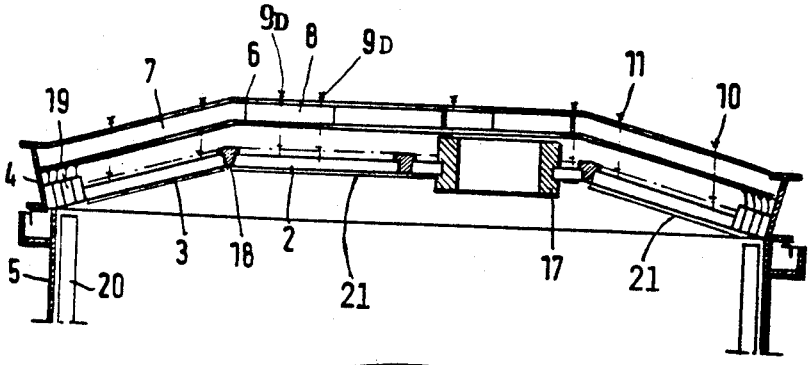
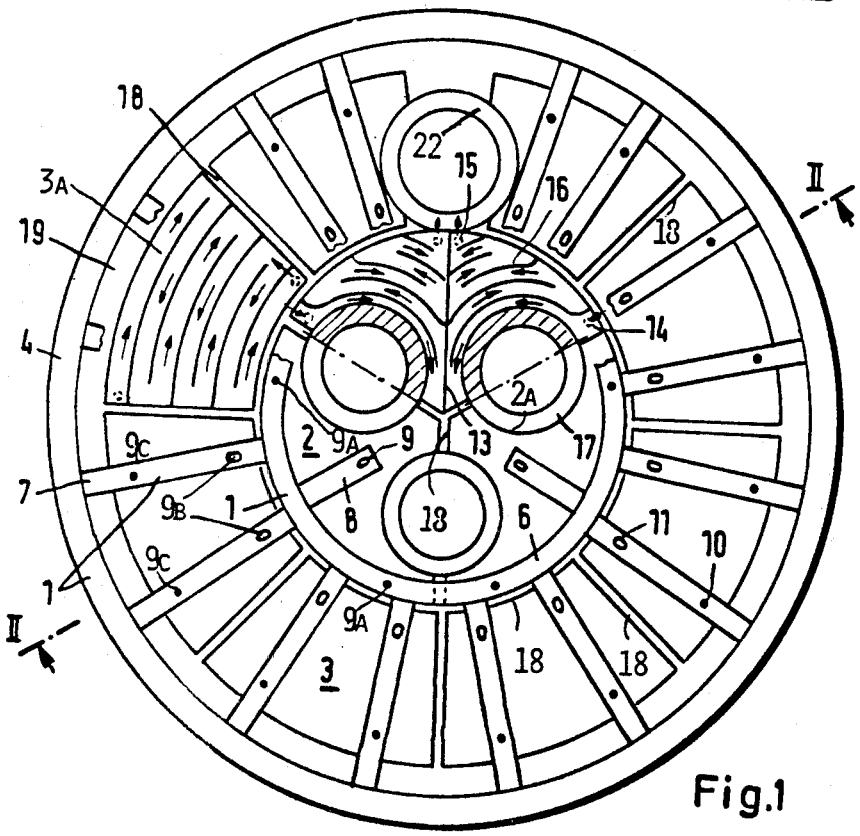
Fig.1

ARC FURNACE ROOF

This application is a continuation-in-part of application Ser. No. 030,862 filed Apr. 17, 1979 now abandoned.

BACKGROUND OF THE INVENTION

An arc furnace designed to melt down scrap and process a resulting melt basically comprises a refractory lined vessel having a refractory hearth for containing the melt and a roof having openings through which arcing electrodes are passed. The vessel can be charged with scrap, and the electrodes adjusted to form arcs with the scrap, and during this meltdown phase, the arcs do not operate smoothly, causing the electrodes to receive relatively violent transverse movements, the impact of which is received by the roof.

The vessel has an opening in its side above the hearth, leading to a pouring spout, and is designed to tilt in the direction of the opening so that a melt in the hearth can the poured from the vessel.

The inside of the roof is directly exposed to thermal radiation from the arcs and from the melt in the hearth.

There are various prior art proposals for using water-cooled segments for an arc furnace roof, exemplified as follows: German Offenlegungsschrift No. 26 39 378, German Offenlegungsschrift No. 2 546 142, German Publication "Fachberichte Hüttenpraxis Metallverarbeitung", 1978, pages 77–81.

The object of this invention is to provide an arc furnace roof formed from cooled segments which do not require thick refractory linings on their bottoms exposed to the furnace heat, and which is particularly resistant to damage in the area adjacent to the arcing electrodes. It is there that the roof should be particularly capable of absorbing radial impact loads from the transverse movements of the electrodes.

DESCRIPTION OF THE INVENTION

According to the present invention and using a three electrode AC furnace as an example, the roof is made with a circular inner portion comprising three suspended segments each being a circular sector and together forming a circular group, the mutually interfacing radial sides of the segments being formed as semicircles so that together the segments form the electrode openings. The segments can be made of steel, are hollow, and each internally has a central radial wall forming two separated compartments each provided with a cooling water inlet and outlet. Each compartment has a series of internal curved or arcuate baffles forming arcuate flow passages each opening to the other alternately at opposite ends. The baffles are concentric or partially so with the semicircles forming, with the other segments, the electrode openings. Preferably, the baffle closest to the opening is in each instance substantially concentric with the semicircle of that compartment of the segment, the next is less so, and so on to the radially outermost baffle. Preferably, the inlet flow is introduced to the radially innermost passage formed by the innermost baffle, the flow then progressing as a radially outwardly extending series of flows alternately traveling in opposite directions and in a curved manner to the outer end of the series. In other words, the cooling water inlet opens into the inner one of the flow series and the outlet opens from the radially outermost one as to each compartment.

Because of the internally traveling curved flows of cooling water, the furnace heat is removed from the segments so effectively that they do not require thick refractory thermal insulation on their bottom sides. Only to electrically isolate the segments from scrap which might possibly be piled so as to reach the furnace roof, the bottom sides of the segments should be coated with refractory electrical insulation, but the thickness of this insulation need not be very great, it not being required for thermal insulation. A refractory enamel that is only from 0.5–3 mm thick is sufficient, a metal oxide ceramic material being appropriate.

When the segments are in position together so that their semicircular side portions form the electrode openings, refractory bushings can be positioned in the openings to electrically isolate the electrodes from the segments. Such bushings or opening linings can be provided by brick work suspended by the segments and for structural strength providing a wall thickness of, for example, from 10–20 cm. Heat is removed from these bushing constructions very efficiently by the unique cooling arrangement previously described.

Importantly, it is because of the cooling efficiency obtained when the segments are supplied with cooling water having a high flow rate and which first in effect sweeps around the electrode bushing constructions and then, never going in a straight line, wipes heat from one baffle after another unitl discharge, that the usual thick refractory bottom lining material is not required. Although made of metal, as exemplified by steel, the segments do not become so heated by the furnace heat or the arc radiation as to be damaged or have impractically short service lives. The baffles themselves are, of course, made of metal and can be integrally connected to the bottom walls of the segments so as to conduct upwardly heat from these bottoms, the heat being removed by the unusually effective heat transfer to the cooling water. The thin electrically insulating layers on the segment bottoms are only electrically effective, having no appreciable thermal insulating value.

The operation of any arc furnace requires that heavy currents pass through the electrodes, and in the case of an AC furnace, eddy currents forming in the group of segments is a possiblity and might induce objectionable heating of the segments. Therefore, the individual segments are electrically insulated from one another by strips of refractory electrical insulation separating their mutually interfacing radial sides, these sides preferably being flat. To do this, the insulation strips can be appropriately shaped, such as by having a T cross section, so that they can be positioned with their tops on the tops of two adjacent segments, with their legs depending between the segments.

The strips can be made of elastic refractory material, such as asbestos fiber matte material, with at least their legs which separate the segments made with substantial thickness, such as in the area of 2 to 5 cm thick. Then the strips not only electrically insulate the segments from each other but also serve as elastic shock-absorbing elements.

Keeping in mind that the electrodes can exert horizontal shock impacts to the segments, such as during meltdown, the segments become shock-absorbing elements which are themselves protected against damage by the impacts they receive. An impact against any one segment is distributed to the other segments in an elastic shock-absorbing manner.

Such electrically insulating strips or separators between the segments also function as seals providing a substantially gas-tight roof assembly.

To support the new center portion, a metal structure can be arranged above or overhead, in the form of a framework having an outer ring supported by the periphery of the entire furnace roof or possibly directly by the furnace side wall. Structural radial members can extend from this outer ring to an inner ring having the diameter of the new central roof portion, or substantially that diameter, and from the inner ring suspension members may form connections with the inner portion segments so that they are collectively suspended as a group. The new central portion is a flexible assembly by reason of its construction. To retain this flexibility, each segment can be suspended at only two points adjacent to its outer peripheral ends and to a single point centrally and inwardly thereof and approximately about halfway radially inwardly to a point in radial alignment with the apex of the segment, this being done in each instance by a radially inwardly extending cantilever fixed to the inner ring of the framework.

For suspension, tension rods can extend from the framework to the segments at the points mentioned. Again, to avoid possible eddy currents, these suspension rods can be electrically insulated either or both at their connections with the framework and the segments. Long bolts and electrically insulating bushings can be used. So that the segments are not rigid to radial motion, the holes on the inner ends of the cantilevers can be radially elongated so that the bolts or other suspension members are not required to flex excessively during radial segment motion.

To provide the roof with an annular outer portion, segments substantially corresponding to those used for the circular inner roof portion, may also be suspended as a group from the suspension framework. These segments are in annulus sector form with their radially inner ends conforming to the circular shape of the inner portion, and they may be provided with generally corresponding baffles and cooling fluid inlets and outlets excepting that in this case the baffles are curved substantially concentrically with respect to the circular inner portion. In this case each segment of the outer annular roof portion can be suspended at four points by radial members connecting the inner and outer rings of the supporting structure. The suspensions can be substantially as previously described.

Also, the segments forming the annular outer portion preferably have their radial interfacing sides separated by the electrical insulation strips previously described, and their arcuate inner walls separated from the circular inner assembly also by the insulating strips.

To prevent short circuits caused by dust deposits and to improve the impermeability of the roof, the entire assembly of segments can be covered by a refractory layer which should, however, permit at least slight individual movements of the segments. Even though the segments provide unusually efficient cooling, their tops will operate at temperature considerably above the ambient temperature of the atmosphere around the outside of the furnace and, therefore, it is preferred that the refractory overall covering be from 5 to 10 cm. thick to reduce heating of the ambient atmosphere.

It can be seen from the foregoing that the new roof inherently has a long service life.

In addition, the semicircular curved webs formed by the segments to provide the electrode passages or openings, should not be very thick because it is here that via the arcuate side walls of the segments the heat is removed from the refractory bushings heated by the arcing electrodes. This is possible with the new construction because it is around the inside of these side wall portions forming the electrode openings that the cooling water first sweeps in its arcuate or curved path so as to most effectively pick up and carry away heat.

Radial impact forces received by each segment individually is absorbed by the segment involved radially moving slightly against the elastic resistance of the shock-absorbing electrical insulating strips separating elastically the segments not only from each other, but also from the annular outer portion of the roof, the segments of this outer portion being each, in turn, elastically held by each other.

BRIEF DESCRIPTION OF THE DRAWINGS

The accompanying drawings show only those parts necessary to illustrate the principles of the invention, the various figures being as follows:

FIG. 1 is a top view of the new roof with parts partially broken away or cross sectioned where necessary for illustrative purposes; and FIG. 2 is a cross section taken on the line II-II in FIG. 1.

DETAILED DESCRIPTION OF THE DRAWINGS

Those drawings show the segment-suspending structural framework 1 from which the group of segments 2 of the circular inner portion and the group of segments 3 of the annular outer portion are suspended. This suspension construction or framework can be fabricated from steel structural members to provide the outer ring 4 supported on the usual steel shell 5 of the furnace vessel side wall, and with the inner ring 6 supported by upwardly inclined radial braces 7, the cantilevers 8 extending radially inwardly from the ring 6 so as to complete the segment-suspending structure 1. The ends of the cantilevers 8 have the radially elongated holes 9 formed through them and the inner ring 6 has the holes **9*a*, these three holes being positioned so that each of the inner group of segments is supported at three points, two near the terminations of its periphery and one approximately one-half way to its apex and symmetrically positioned with respect to the other two holes 9*a***.

The outer annular array of segments are similarly suspended excepting that pairs of the braces 7 are positioned symmetrically with respect to a segment therebeneath. Four suspension points are involved, two via tie bolts or the like through radially elongated holes **9*b* at the inner ends of the braces 7, and near the braces' outer ends via holes 9*c***.

The suspension rods or bolts, suitably electrically insulated from the supporting framework, are indicated in FIG. 2 at **9*d* for supporting the inner assembly of segments, while those elements for the outer segments are indicated at 10 and 11**. The details of these suspension members and their necessary electrical insulating parts are not shown in detail because their design is readily understood.

The elongated holes 9 and **9*b*** are, of course, to permit radial movement of the suspended segments without requiring excessive flexing of the suspension members.

As previously noted, the interfacing radial sides of each two of the segments 2 are formed in each instance as a semicircle, indicated at **2*a*, so that the two sides form one of the electrode passages or openings, the electrodes not being shown. Each segment 2 of circular sector shape is divided into two cooling fluid compartments of equal size by an internal wall 13 which extends radially from the apex of the segment to the middle part of its outer peripheral wall. Each segment has a cooling fluid supply means or inlet 14 and a discharge means or outlet 15. In each instance, the inlets 14 open into the arcuate flow passage formed by the inner one of the internal baffles 16 previously noted. These baffles 16 are arranged so that each of the curved or arcuate flow passages opens at alternate ends with respect to each other, the flow pattern being indicated by arrows in FIG. 1**. With a good flow of cooling water the intense cooling action is obtained. The innermost baffle is shown in each compartment as being concentric with the semicircular portion of the segment's side wall, each outwardly successive baffle curving to a successively increasing radius.

The bushings 17 built or arranged in the openings formed by the segments can be approximately 15 cm thick and can be made from individual refractory bricks to form a brickwork having an annular groove engaged by the tops and bottoms of the segments, the arcuate walls of the segments firmly engaging the bushing 17 for good heat removal therefrom.

The previously noted asbestos strips of T shape and having legs about 3 cm thick, are illustrated at the points mentioned. These strips are shown at 18, made of elastic, although compacted, asbestos fibers providing the electrical insulation and shock-absorbing functions previously explained. The segments and these strips form a gas-impervious roof.

The outer annular group or array of segments with their previously described internal baffles 3*a*, concentrically curved with respect to the roof's axis, outwardly terminates a short distance on the inside of the furnace side wall lining (not illustrated) and an annular refractory lining of brickwork 19 is positioned between the outer ring 4 of the supporting structure and the arcuate end walls of the segments 3. This prevents possible leaking coolant from running down between the furnace side wall shell 5 inside of water-cooling plates 20 which may possibly be built behind or partially in the furnace side wall lining.

It can be seen that the entire roof is made of flexibly interassociated water-cooled segments and that, in each case, the rapidly flowing arcuate flows of alternately moving water removes the furnace heat so effectively that no heavy and thick refractory bottom lining is required. The bottom walls of each of the hollow segments are efficiently cooled by the flows which rapidly reverse. Even though the segments directly receive the furnace heat, including the arc radiation, they are very durable and have long service lives. Lateral shock from the electrodes is distributed in an elastically flexibly resisting manner throughout the roof structure by the action of the various insulating strips 18.

Insofar as is possible, the water-cooling outlets of the various segments and particularly in the case of the group of segments forming the inner or central portion of the roof and, therefore, receiving the maximum heating, are positioned so that when the furnace tilts, the outlets are uppermost, thus preventing or at least reducing blockage of the cooling passages by steam pockets. The steam rising upwardly can escape. During furnace tilting, with the roof also tilting, the various insulating and shock-absorbing strips 18 hold the segments adequately against shifting downhill.

The new roof is particularly useful in the case of a multi-phase AC arc furnace using a plurality of arcing electrodes, but the principles involved may possibly be applied in the case of a DC furnace using only one electrode, the power circuit then being completed via a connection with the melt in the hearth.

Although not illustrated, the connections for the various inlets and outlets for the different segments can be made through suitable piping, possibly flexible, and well within the designing ability of those skilled in the art.

As previously mentioned, the radial sides of the segments 2 of the circular inner group of segments are flat in the vertical direction and, as is illustrated, are just slightly longer radially than their semicircular side wall portions which via the refractory bushings 17 define the openings in which the electrodes move up and down during furnace operation. Therefore, by reason of the radial dividing wall 13, the innermost arcuate baffle of the series of baffles 16 closely embraces the inside of the circular side wall portion of each segment while leaving only sufficient space at the ends of this innermost curved baffle for free entrance of the cooling water at 14 and, at the inner end, for free flow of the cooling water into the next radially outer passage formed by the next baffle. As to each of the electrode openings, the just introduced cooling water flows for only about 180° so that each semicircular segment side wall portion is individually cooled, the radial wall 13 separating the flows to each segment as to each semicircular side wall portion. Radially outwardly the curved baffles are successively spaced farther and farther apart while the radius of their curvature increases, the flow resistance therefore constantly diminishing outwardly as the cooling water becomes hotter and hotter and the circumferential lengths of the flow passages become shorter.

With the radial walls 13 and the baffles 16 made integral with the top and bottom walls of the segments, excellent heat conductivity paths are formed from the bottom walls of the segments upwardly, so that the cooling water flow curving forwardly and backwardly wipes the entire segment bottoms and the side walls and baffles from heat so efficiently as to eliminate the need for the usual heavy and thick refractory lining characteristically used for the inside of an arc furnace roof. The refractory bushings 17 have a relatively great wall thickness to resist the mechanical abuse to which they are subjected by the impacts they receive from the electrodes.

All of the segments are made of metal including those of the annular outer group and the latter should also have its baffles 3*a* connected top and bottom to the top and bottom walls of the annulus sector segments. For the same reason the bottoms of the outer segments may be covered by thin electrical insulation, indicated at 21 in FIG. 2, where relative to the vertical thickness of the segments the electrical insulating layer or coating is necessarily illustrated as being much thicker than it actually would be.

Over the entire roof all of the segments are individually electrically isolated from the others by the strips 18 which, in addition provide for the elastic give and take of the roof when stressed via the bushings 17 by electrode impacts. Each segment thus electrically and elastically mechanically isolated from the others, can move slightly because the long tension bolts or rods suspending the segments from the overhead metal structure are individually capable of slight flexing action. The elongated holes 9 and **9*b*** are mainly to accommodate thermal expansion of the inner and outer segments without requiring static deflection of the bolts or rods when the roof heats to its operating temperature.

For exhausting furnace gases from the furnace, the roof is shown in FIG. 1 as providing an exhaust opening 22, the two outer segments being formed with curved side walls to accommodate this opening which could be refractory lined somewhat in the manner of the bushings 17.

The unillustrated cooling water piping would, of course, extend upwardly from the segments to form an overhead system shielded from the furnace heat.

Because the suspension means position the individual segments without the segments being otherwise held to each other, the segments can be hung one at a time during building of the roof, easily aligned with each other as by using bolts as the suspension elements, and a damaged segment can be removed for repair or replacement without disturbing the other segments. Suspension element connectors can be welded to or cast in the segment tops where they are easily accessible.

What is claimed is:

1. An arc furnace roof formed by an annular outer group of metal segments and an inner circular group of metal segments and overhead means for individually suspending the segments to form a roof structure, the segments not being otherwise held to each other, the segments of the inner group being shaped as circular sectors and having interfacing radial side walls of which at least two have semicircular side wall portions cooperatively forming at least one arcing electrode passage and having a refractory electrically insulating bushing in said passage, each of the segments of the inner group being hollow and having at least one cooling fluid inlet and outlet and internally containing a series of baffles for guiding cooling fluid as alternately reversing flows extending from the inlet to the outlet, and each having a bottom wall exposed to the interior of an arc furnace using the roof and which is free from refractory thermal insulation.

2. The roof of claim 1 in which each segment of said inner circular group internally has a cental radial wall extending from its apex formed by its circular sector shape radially to the middle of its outer peripheral wall so as to divide its interior into two compartments, each compartment having said inlets and outlets individually and containing one of said series of baffles.

3. A roof according to claim 1 and in which said series of baffles is formed by arcuate baffles forming arcuate flow passages each opening to the other alternately at opposite ends, said inlet opening into the one of said passages adjacent to said semicircular side wall portions, at least the innermost ones of said baffles being substantially concentric with said semicircular side wall portion.

4. The roof of claim 1 and in which strips of elastic refractory electrical insulating material is positioned between said interfacing radial side walls of the segments.

5. The roof of claim 1 in which said annular outer group of metal segments are shaped as annulus sectors with inner ends conforming to the circular shape of said inner group of segments, the segments of said outer group being hollow and each having at least one cooling fluid inlet and outlet and internally containing a series of baffles which are curved about the axis of the roof and form arcuate flow passages each opening to the other alternately at opposite ends and into which the just-named inlet and outlet open at radially opposite positions, strips of said insulating material being positioned between the sides of all segments of the roof.

6. The roof of claims 1, 2, 3, 4, or 5 in which the bottoms of said segments are covered by a layer of electrical insulation too thin to function alone as thermal insulation.

* * * * *